US006112036A

United States Patent [19]

Shinohara

[11] Patent Number: 6,112,036

[45] **Date of Patent: *Aug. 29, 2000**

[54] IMAGE FORMING APPARATUS FOR JUDGING LIFE OF PHOTOSENSITIVE MEMBER BASED ON REVOLUTION NUMBER OF INTERMEDIATE TRANSFER MEMBER

[75] Inventor: Hayato Shinohara, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/685,472

[22] Filed: Jul. 24, 1996

[30] Foreign Application Priority Data

Jul. 24, 1995 [JP] Japan ..... 7-187473

[51] Int. Cl.[7] ..... G03G 15/00

[52] U.S. Cl. ..... 399/24; 399/26

[58] Field of Search ..... 399/24–26

[56] References Cited

U.S. PATENT DOCUMENTS

| | | | |
|---|---|---|---|
| Re. 35,751 | 3/1998 | Midgley | 399/25 |
| 4,551,000 | 11/1985 | Kanemitsu et al. | 399/111 |
| 4,707,748 | 11/1987 | Ohtsuka et al. | 358/298 |
| 4,961,088 | 10/1990 | Gilliland et al. | 399/25 |
| 5,101,233 | 3/1992 | Ito et al. | 399/24 |
| 5,159,388 | 10/1992 | Yoshiyama et al. | 399/26 |
| 5,160,967 | 11/1992 | Tonegawa | 399/26 |
| 5,249,022 | 9/1993 | Watanabe et al. | 399/303 |
| 5,272,503 | 12/1993 | LeSueur et al. | 399/25 |
| 5,278,612 | 1/1994 | Inui | 399/26 |
| 5,572,292 | 11/1996 | Chatani et al. | 399/25 |
| 5,822,646 | 10/1998 | Kinoshita et al. | 399/24 |
| 5,838,456 | 11/1998 | Wagi et al. | 399/302 X |

*Primary Examiner*—William J. Royer

*Attorney, Agent, or Firm*—Fitzpatrick, Cella, Harper & Scinto

[57] ABSTRACT

Disclosed is an image forming appartus for judging life of photosensitive member based on revolution number of intermediate transfer member. The image forming apparatus is provided with a photosensitive rotary drum for carrying an electrostatic latent image, a developing unit for developing the electrostatic latent image on the photosensitive rotary drum with a toner, a medium transfer rotary member to which the toner image on the photosensitive drum is transferred and mediates the toner image between the photosensitive drum and a recording sheet, an integration counter for integrating revolution number information of the medium transfer rotary member, and a judging unit for judging a life of the image holding member on the basis of the number of revolutions counted by a counter. A circumference of the medium transfer rotary member is substantially integer times as large as a circumference of the photosensitive drum. The apparatus has a nonvolatile memory to store the number of revolutions of the photosensitive drum.

8 Claims, 13 Drawing Sheets

PHOTOSENSITIVE DRUM CIRCUMFERENCE : $\ell = t \times \pi$

ITD CIRCUMFERENCE : $L = T \times \pi$ $L/\ell = N$

IMAGE FORMING APPARATUS FOR JUDGING LIFE OF PHOTOSENSITIVE MEMBER BASED ON REVOLUTION NUMBER OF INTERMEDIATE TRANSFER MEMBER

BACKGROUND OF THE INVENTION

1. Field of the Invention

The invention relates to an image forming apparatus such as copying apparatus, printer, or the like and, more particularly, to an image forming apparatus for laminating a toner layer onto an intermediate transfer member.

2. Related Background Art

In an electrophotographing apparatus, since a life of a photosensitive member is generally shorter than that of the apparatus main body, when the life of the photosensitive member has expired, the photosensitive member is exchanged to a new one.

It is, therefore, necessary to judge whether the life of the photosensitive member has expired or not.

FIG. 12 shows a mechanism for detecting a life of a photosensitive member from a current flowing to the photosensitive member.

As shown in FIG. 12, a bias voltage 121 is applied to a primary charging member (charging roller) 17. A conductive substrate of a photosensitive member (photosensitive drum) 15 is connected to the ground. A capacitor is equivalently formed by the charging roller 17 and the conductive substrate. A voltage is detected with a detecting resistor 122 from a current Idc flowing to the capacitor. A film thickness d is measured by a detecting circuit 123 on the basis of the detected voltage.

Namely, the current Idc flowing to the surface of the photosensitive drum 15 is expressed by $$Idc=(\Delta C/\Delta t)\times Vd.\ \Delta C=\epsilon S/d$$

($\epsilon$: dielectric constant, S: contact area of the charging roller and the photosensitive drum, d: film thickness of photosensitive drum). From the above both equations, $$d=\epsilon S\cdot Vd/(Idc\cdot\Delta t).$$

However, in the above life detecting device for detecting the life by measuring the film thickness of the photosensitive drum 15, the current Idc is a very small current, and hence in order to increase a film thickness detecting precision, parts of a very high amplification and a very high precision are needed, thus the apparatus is easily affected by noises and often operates erroneously. Therefore, a high precision and a high noise resistance are required for the life detecting device. There is a problem such that the costs rise in association with it.

As a simple method of life detecting, therefore, it is considered to measure the number of revolutions of the photosensitive drum 15 and to store it as life information in a memory.

However, when a diameter of the photosensitive drum is reduced, the number of revolutions increases and a large memory capacity is needed.

SUMMARY OF THE INVENTION

It is an object of the invention to provide an image forming apparatus which can easily detect the life of a photosensitive member.

Another object of the invention is to provide an image forming apparatus which can store life information of a photosensitive member by a small memory capacity.

Still another object of the invention is to provide an image forming apparatus being provided with: an image carrying rotary member for carrying an electrostatic image; developing means for developing the electrostatic image on the image carrying member with a toner; a medium transfer rotary member to which the toner image on the image carrying member is transferred and which mediates the toner image between the image carrying member and a recording member; integrating means for integrating revolution number information of the medium transfer rotary member; and judging means for judging a life of the image carrying member on the basis of the number of revolutions counted by the counting means.

The above and other objects and features of the present invention will become apparent from the following detailed description and the appended claims with reference to the accompanying drawings.

DETAILED DESCRIPTION OF THE PREFERRED EMBODIMENTS

An embodiment of the invention will now be described hereinbelow with reference to the drawings.

Figure 2:
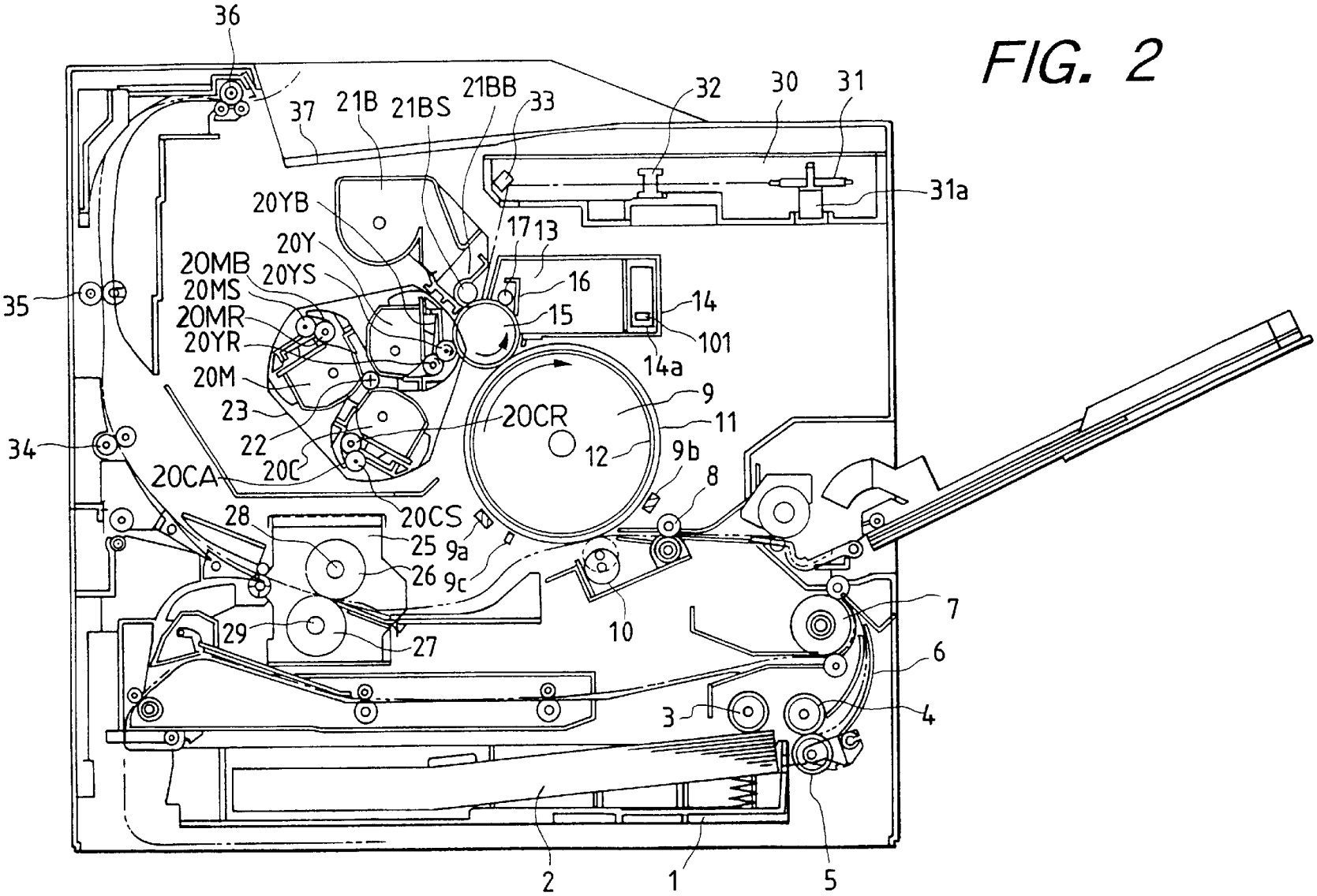
FIG. 2 is a whole constructional diagram showing a laser printer as a color image forming apparatus according to the invention.

FIG. 2 is a cross sectional view of a full color electrophotographic printer as an image forming apparatus according to the embodiment of the invention.

As shown in FIG. 2, according to a laser printer, in an image forming apparatus, an electrostatic latent image is formed by an image light produced on the basis of an image signal obtained by scanning an original, the electrostatic latent image is developed to form a visible image (toner image), and the visible image is multiple-transferred to form a color visible image. The color visible image is transferred to a transfer member 2, and the color visible image on the transfer member 2 is fixed. The image forming apparatus is composed of a photosensitive member unit, the contact charging roller 17 as primary charging means, cleaning means, developing means, an intermediate transfer member 9, a paper supply unit, a transfer unit, and a fixing unit 25.

A construction of each portion of the image forming apparatus will now be sequentially described in detail.

Photosensitive Member Unit

A drum unit 13 is formed by integratedly constructing the photosensitive drum (photosensitive member) 15 and a cleaner container 14 of cleaning means also serving as a holder of the photosensitive drum 15. The drum unit 13 is attachably/detachably supported to a printer main body and is constructed so as to be easily exchanged in accordance with a life of the photosensitive drum 15. The photosensitive drum 15 is formed by coating an organic photoconductive material layer onto curved surface of an aluminum cylinder (refer to FIG. 3) and is rotatably supported to the cleaner container 14. The photosensitive drum 15 is rotated by transferring a driving force of a drive motor (not shown) to the drum 15. The drive motor rotates the photosensitive drum 15 counterclockwise in accordance with the image forming operation. A cleaner blade 16 and the contact charging roller 17 as primary charging means are arranged around the circumference of the photosensitive drum 15 along the rotating direction thereof.

An enclosing area 14*a* to receive a board on which an EEPROM 101 as a nonvolatile memory (explained hereinlater) has been mounted, is provided in the cleaner container 14.

An exposing light to the photosensitive drum 15 is sent from a scanner unit 30. Namely, when an image signal is supplied to a laser diode, the laser diode irradiates the image light corresponding to the image signal to a polygon mirror 31. The polygon mirror 31 is rotated at a high speed by a scanner motor 31*a*. The image light reflected at the polygon mirror 31 selectively exposes the surface of the photosensitive drum 15 rotating at a constant speed through an image forming lens 32 and a reflecting mirror 33, thereby forming an electrostatic latent image.

Primary Charging Means

The contact charging roller 17 as primary charging means is arranged in contact relation with the photosensitive drum 15. By applying a voltage to the contact charging roller 17, the surface of the photosensitive drum 15 can be uniformly charged.

Developing Means

Developing means has a construction including three color developing units 20Y, 20M, and 20C for developing images of yellow (Y), magenta (M), and cyan (C) and one black developing unit 21B for developing an image of black (B) in order to visualize the above electrostatic latent image. Sleeves 20YS, 2OMS, 20CS, and 21BS are provided in the three color developing units 20Y, 20M, 20C, and the black developing unit 21B, respectively. Coating blades 20YB, 20MB, 20CB, and 21BB which are come into pressure contact with curved surfaces of the sleeves 20YS, 20MS, 20CS, and 21BS are provided in the color developing units 20Y, 20M, 20C and the black developing unit 21B, respectively. Coating rollers 20YR, 20MR, and 20CR are provided in the three color developing units 20Y, 20M, and 20C, respectively.

The black developing unit 21B is detachably attached to the printer main body. The color developing units 20Y, 20M, and 20C are detachably attached to a developing rotary 23 which rotates around a rotary axis 22 as a center, respectively.

The sleeve 21BS of the black developing unit 21B is arranged for the photosensitive drum 15 so as to have a very small interval of, for example, about 300 $\mu$m from the drum 15. The black developing unit 21B conveys a toner by a feeding member built in the unit 21B and applies charges to the toner by a frictional electrification onto the curved surface of the sleeve 21BS rotating clockwise so as to coat by the coating blade 21BB. By applying a developing bias to the sleeve 21BS, a development is performed to the photosensitive drum 15 in accordance with the electrostatic latent image, thereby forming a visible image with the black toner onto the photosensitive drum 15.

The three color developing units 20Y, 20M, and 20C are rotated in association with the rotation of the developing rotary 23 upon formation of an image. A predetermined one of the sleeves 20YS, 20MS, and 20CS faces the photosensitive drum 15 so as to have a very small interval of about 300 $\mu$m. Thus, the predetermined one of the color developing units 20Y, 20M, and 20C stops at a developing position which faces the photosensitive drum 15 and a visible image is formed on the photosensitive drum 15.

When a color image is formed, the developing rotary 23 rotates every revolution of the intermediate transfer member 9. The developing steps are sequentially performed in accordance with the order of the yellow developing unit 20Y, magenta developing unit 20M, cyan developing unit 20C, and subsequently, black developing unit 20B. The intermediate transfer member 9 rotates four times and sequentially forms visible images by toners of yellow, magenta, cyan, and black, so that a full color visible image is formed on the intermediate transfer member 9.

It is now assumed that the yellow developing unit 20Y is positioned and stands still so as to face the photosensitive drum 15 as shown in FIG. 2. Thus, the toner in the yellow developing unit 20Y is conveyed to the coating roller 20YR by the feeding member (not shown). The toner is coated by the coating blade 20YB onto the curved surface of the sleeve 20YS rotating clockwise and charges are applied (frictionally electrification) to the toner. A bias voltage is applied to the sleeve 20YS which faces the photosensitive drum 15, thereby performing the development by the yellow toner onto the photosensitive drum 15 in accordance with the electrostatic latent image. Then, the toner development is executed with respect to the magenta developing unit 20M and cyan developing unit 20C by a process similar to the developing process by the yellow developing unit 20Y mentioned above.

High voltage power sources for development provided in the printer main body and driving sources for rotating the sleeves 20YS, 20MS, and 20CS are connected to the sleeves 20YS, 20MS, and 20CS, respectively. When the color developing units 20Y, 20M, and 20C rotate and face the developing position, the high voltage power sources for development and driving sources are made conducted and sequentially selectively apply voltages to the color developing units 20Y, 20M, and 20C and drive them.

Intermediate Transfer Member

The intermediate transfer member 9 is constructed so as to rotate in contact with the photosensitive drum 15 in association with the rotation of the drum 15. When a color image is formed, the intermediate transfer member 9 rotates clockwise and is subjected to a multiple transfer of a visible image of four times from the photosensitive drum 15. When the image is formed, a transfer roller 10 (explained hereinlater) is come into contact with the intermediate transfer member 9 and pinches and conveys the transfer member 2, whereby the color visible image on the intermediate transfer member 9 is simultaneously multiple-transferred onto the transfer member 2.

The intermediate transfer member 9 is formed by coating curved surface of an aluminum cylinder 12 having a diameter of, for example, 180 mm by an elastic layer 11 such as sponge of a middle resistance, rubber of a middle resistance, or the like. An image formation start position detecting sensor (hereinafter, simply referred to as a "TOP sensor") 9*a* for detecting a passage of a flag 9*c* and a paper supply start timing sensor (hereinafter, simply referred to as an "RS sensor") 9*b* are provided around the intermediate transfer member 9. Namely, the TOP sensor 9*a* detects the passage of the flag 9*c* to start the image formation. The RS sensor 9*b* detects the passage of the flag 9*c,* thereby measuring a timing for supplying the transfer member 2.

Transfer Unit

The transfer unit includes the transfer roller 10 as a transfer charging unit supported to the photosensitive drum 15 so as to contact with the drum 15 and be separated from the drum 15. The transfer roller 10 is formed by wrapping an expanded elastic material of a middle resistance around a metal shaft. As shown by a solid line in FIG. 2, while the color visible image is being multiple-transferred onto the intermediate transfer member 9, namely, while the intermediate transfer member 9 rotates a plurality of number of times, the transfer roller 10 is away from the intermediate transfer member 9 to a lower position so as not to disturb the color visible image. After the color visible image of four colors has been formed on the intermediate transfer member 9, the transfer roller 10 is located to the upper position shown by a broken line in FIG. 2 by a cam member (not shown) in accordance with a timing when the color visible image is transferred onto the transfer member 2. Thus, the transfer roller 10 is come into pressure contact with the intermediate transfer member 9 through the transfer member 2 with a predetermined pressing force. A bias voltage is also applied to the transfer roller 10, so that the color visible image on the intermediate transfer member 9 is transferred onto the transfer member 2. Since the intermediate transfer member 9 and transfer roller 10 are respectively driven, after completion of the transfer step, the transfer member 2 pinched by both of them is conveyed to a fixing unit 25 in the left direction in FIG. 2 at a predetermined speed.

Paper Supply Unit

The paper supply unit feeds the transfer member 2 to the image forming unit and is constructed by a paper supply cassette 1 in which a plurality of transfer members 2 are enclosed, a paper supply roller 3, a feed roller 4, a retard roller 5 to prevent an overlap feed, a paper supply guide 6, a conveying roller 7, a resist roller 8, and the like. When an image is formed, the paper supply roller 3 is rotated in accordance with the image forming operation. The transfer members 2 in the paper supply cassette 1 are separated and fed one by one. Each transfer member is guided by the paper supply guide 6 and reaches the resist roller 8 via the conveying roller 7. During the image forming operation, the resist roller 8 executes both of a non-rotating operation for allowing the transfer member 2 to stand still in a standby state and the rotating operation for conveying the transfer member 2 toward the intermediate transfer member 9 by a predetermined sequence, whereby the position of the image in the transfer step registers with the position of the transfer member 2.

Fixing Unit

The fixing unit 25 fixes the transferred color visible image while conveying the transfer member 2, and includes a fixing roller 26 to heat the transfer member 2 and a pressurizing roller 27 for allowing the transfer member 2 to be come into pressure contact with the fixing roller 26 as shown in FIG. 2. The fixing roller 26 and pressurizing roller 27 are formed in a hollow shape and have therein heaters 28 and 29, respectively.

Namely, the transfer member 2 holding the color visible image is conveyed by the fixing roller 26 and pressurizing roller 27. The toner is fixed on the surface of the transfer member 2 by applying a heat and a pressure thereto.

The transfer member 2 after the visible image has been fixed, is ejected to an ejecting tray 37 by ejecting roller pairs 34, 35, and 36 and the image forming operation is finished.

Cleaning Means

Cleaning means cleans the toner remaining on the photosensitive drum 15. The drain toner after the visible image by the toner formed on the photosensitive drum 15 has been transferred to the intermediate transfer member 9, is stored into the cleaner container 14. The drain toner to be stored into the cleaner container 14 does not fill the cleaner container 14 earlier than the life of the photosensitive drum 15. Therefore, it is sufficient to integratedly exchange the cleaner container 14 simultaneously with the exchange of the photosensitive drum 15.

Image Forming Operation

The operation of the image forming apparatus constructed as mentioned above will now be described.

First, one of the transfer members 2 in the paper supply cassette 1 is separated by rotating the paper supply roller 3 shown in FIG. 2 and is conveyed to the resist roller 8 and is held in a standby state at this position.

On the other hand, the photosensitive drum 15 and intermediate transfer member 9 rotate in the directions shown by arrows in FIG. 2. The surface of the photosensitive drum 15 is uniformly charged by the contact charging roller 17. A light irradiation of the yellow image is performed by the scanner unit 30 and an electrostatic latent image corresponding to the yellow image is formed on the photosensitive drum 15. Simultaneously with the formation of the electrostatic latent image, the yellow developing unit 20Y is driven and a voltage having the same polarity as the charging polarity of the photosensitive drum 15 and almost the same potential as that of the drum 15 is applied so that the yellow toner is deposited onto the electrostatic latent image on the photosensitive drum 15, thereby performing the yellow development. Subsequently, a voltage having reverse polarity to the charging polarity of the yellow toner is applied to the intermediate transfer member 9, thereby transferring the yellow visible image on the photosensitive drum 15 onto the intermediate transfer member 9.

After the yellow visible image has been thus transferred onto the intermediate transfer member 9, the developing rotary 23 is rotated, thereby allowing the next magenta developing unit 20M to face the photosensitive drum 15. In a manner similar to the yellow development, the magenta toner is deposited to the electrostatic latent image of the photosensitive drum 15, thereby executing the magenta development. After that, the magenta visible image on the photosensitive drum 15 is transferred onto the intermediate transfer member 9.

In a manner similar to the above, the formation of the electrostatic latent images of the cyan image and black image, the development by the cyan developing unit 20C and black developing unit 21B, and the transfer of the cyan visible image and black visible image onto the intermediate transfer member 9 are sequentially executed and the images are overlapped, thereby forming a color visible image composed of the toners of four colors of yellow, magenta, cyan, and black onto the surface of the intermediate transfer member 9.

After the color visible image has been thus formed on the surface of the intermediate transfer member 9, the transfer member 2 held in the standby state at the resist roller 8 is conveyed and is come into pressure contact with the intermediate transfer member 9 by the transfer roller 10. At the same time, by applying a bias voltage having the reverse polarity to that of the toner to the transfer roller 10, the color visible image on the intermediate transfer member 9 is transferred to the transfer member 2. The transfer member 2 after completion of the transfer step is peeled off from the intermediate transfer member 9 and is conveyed to the fixing unit 25, by which the toner is fixed. After that, the transfer member 2 is ejected onto the ejecting tray 37 in the upper portion of the main body through the ejecting roller pairs 34, 35, and 36 in a state in which the image surface is upside down. Thus, the image forming operation is finished.

Figure 1:
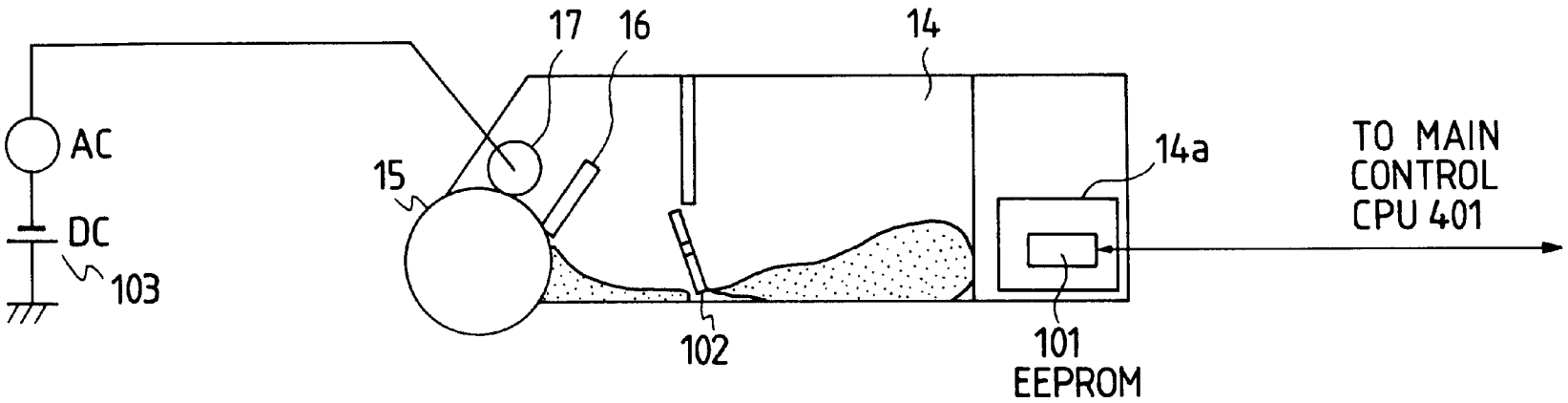
FIG. 1 is a diagram showing a schematic construction of a photosensitive member unit and an electrical connecting state.

FIG. 1 is a diagram showing a schematic construction of the photosensitive member unit and an electrical connecting state. In FIG. 1, reference numeral 101 denotes an EEPROM as a nonvolatile memory connected to a main control CPU 401 (refer to FIG. 4); 102 a feeding member to convey the drain toner collected by the cleaner blade 16 to the cleaner container 14; and 103 a primary charging bias power source to apply a high voltage to the contact charging roller 17.

Figure 3:
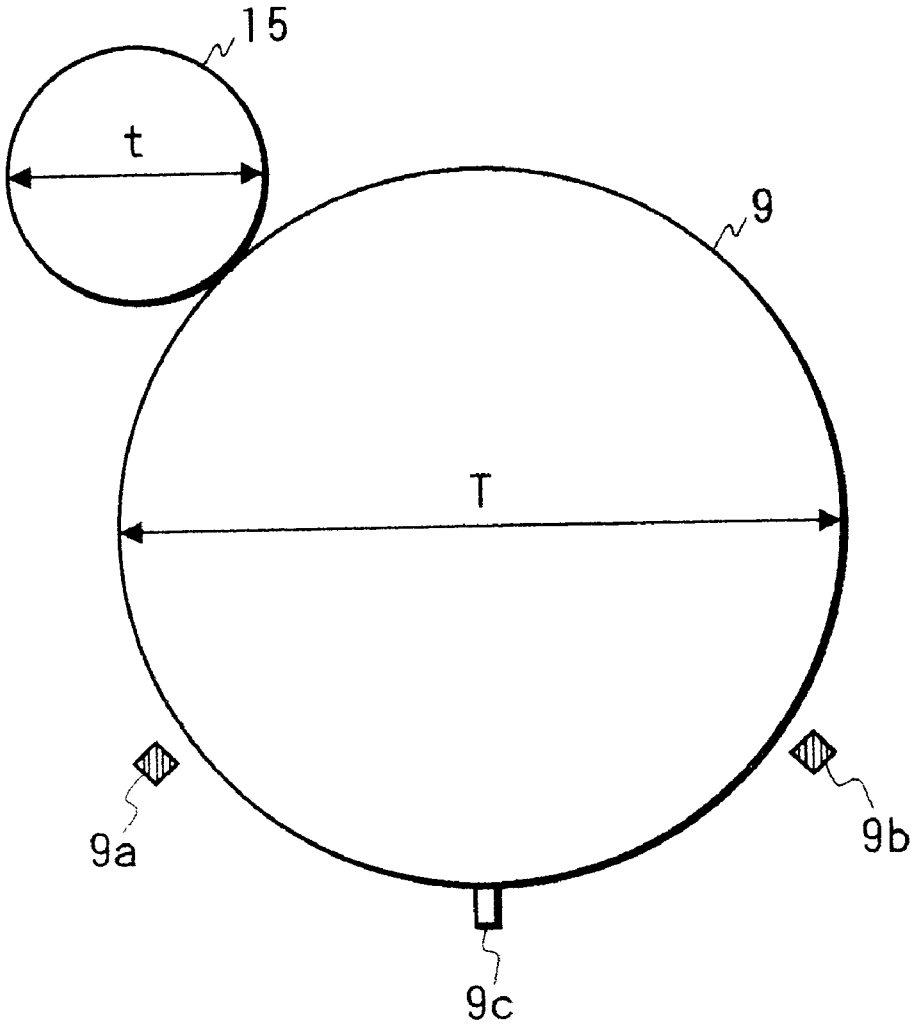
FIG. 3 is a diagram showing the relation between the sizes of a photosensitive drum and an intermediate transfer member.

FIG. 3 is a diagram showing the relation between the sizes of the photosensitive drum 15 and intermediate transfer member 9. Now, assuming that a diameter of the photosensitive drum 15 is t, a circumference l of the photosensitive drum 15 is ($l=t\times\pi$). Now, assuming that a diameter of the intermediate transfer member 9 is T, a circumference L of the intermediate transfer member 9 is ($L=T\times\pi$). There is the relation of ($L/l=N$) (N is an integer) between both of those circumferences. Namely, a result obtained by multiplying N to the number of revolutions of the intermediate transfer member 9 is equal to the number of revolutions of the photosensitive drum 15.

Figure 4:
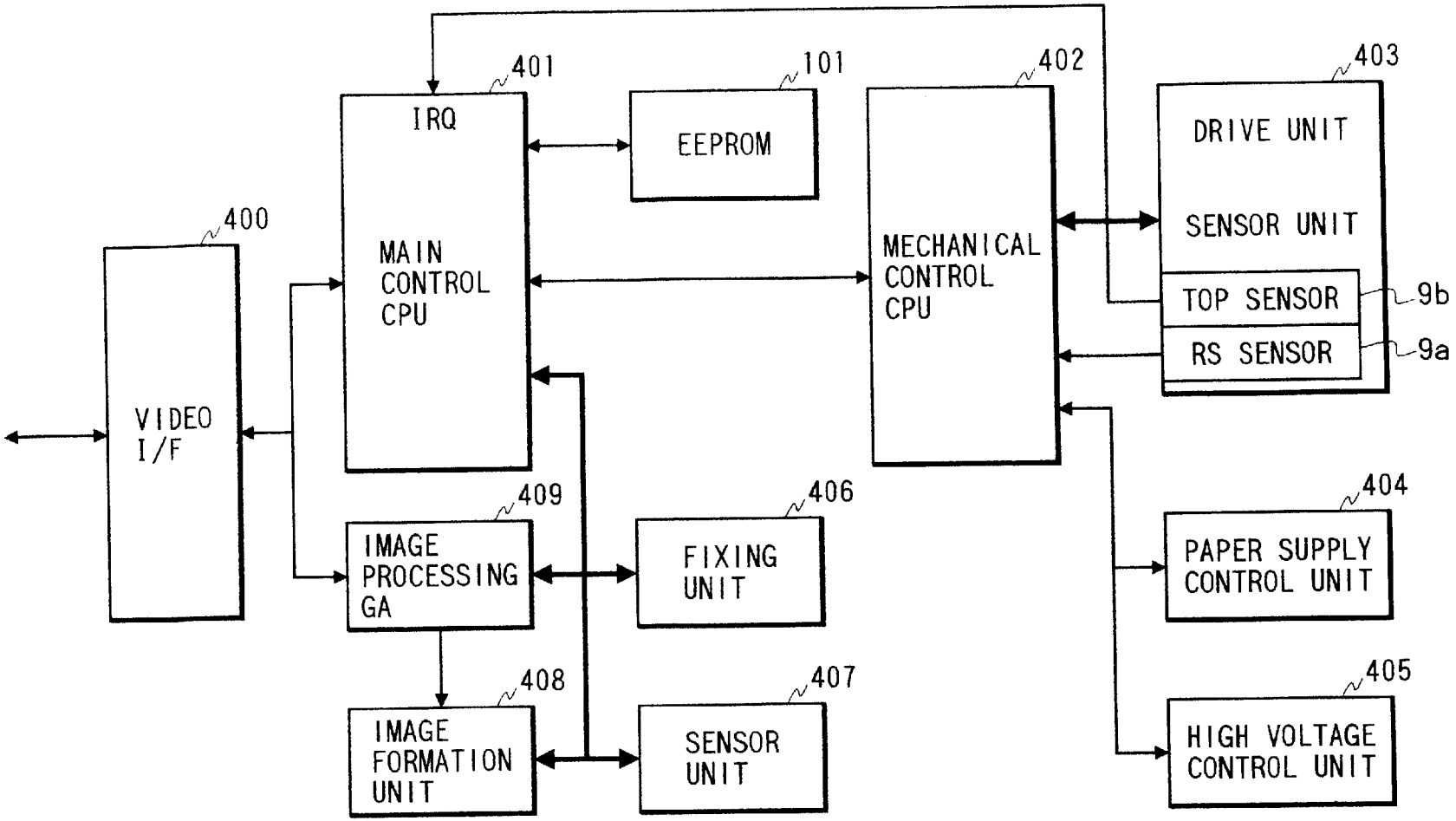
FIG. 4 is a schematic system diagram of an engine unit of the color image forming apparatus.

FIG. 4 is a schematic system diagram of an engine unit of the laser printer. Reference numeral 400 denotes an image data interface as an interface unit for connecting the engine unit to an external controller for controlling the engine unit. A signal from the image data I/F 400 is supplied to a main control CPU 401. The main control CPU 401 controls; a mechanical control CPU 402 of a sub CPU; a fixing unit 406; a sensor unit 407 such as a temperature sensor, a humidity sensor, a toner residual amount sensor, and the like; an image formation unit 408 for performing a laser output and an image output of a scanner motor or the like; and an image processing GA 409 for executing an image process such as γ correction or the like to the image data which is received from the image data I/F 400, respectively. The mechanical control CPU 402 drives a motor, a clutch, a fan, and the like and controls a drive unit/sensor unit 403, a paper supply control unit 404, and a high voltage control unit 405 for detecting the position of the TOP sensor 9*a,* the timing of the RS sensor 9*b,* and the like, respectively. The main control CPU 401 performs a control to write the revolution number information of the intermediate transfer member 9 as life information of the photosensitive drum 15 measured, into the EEPROM 101 in the photosensitive member unit at the time of turn-off of the power source. The main control CPU 401 also performs a control to read out the life information of the photosensitive drum 15 stored in the EEPROM 101 upon turn-on of the power source.

Figure 5:
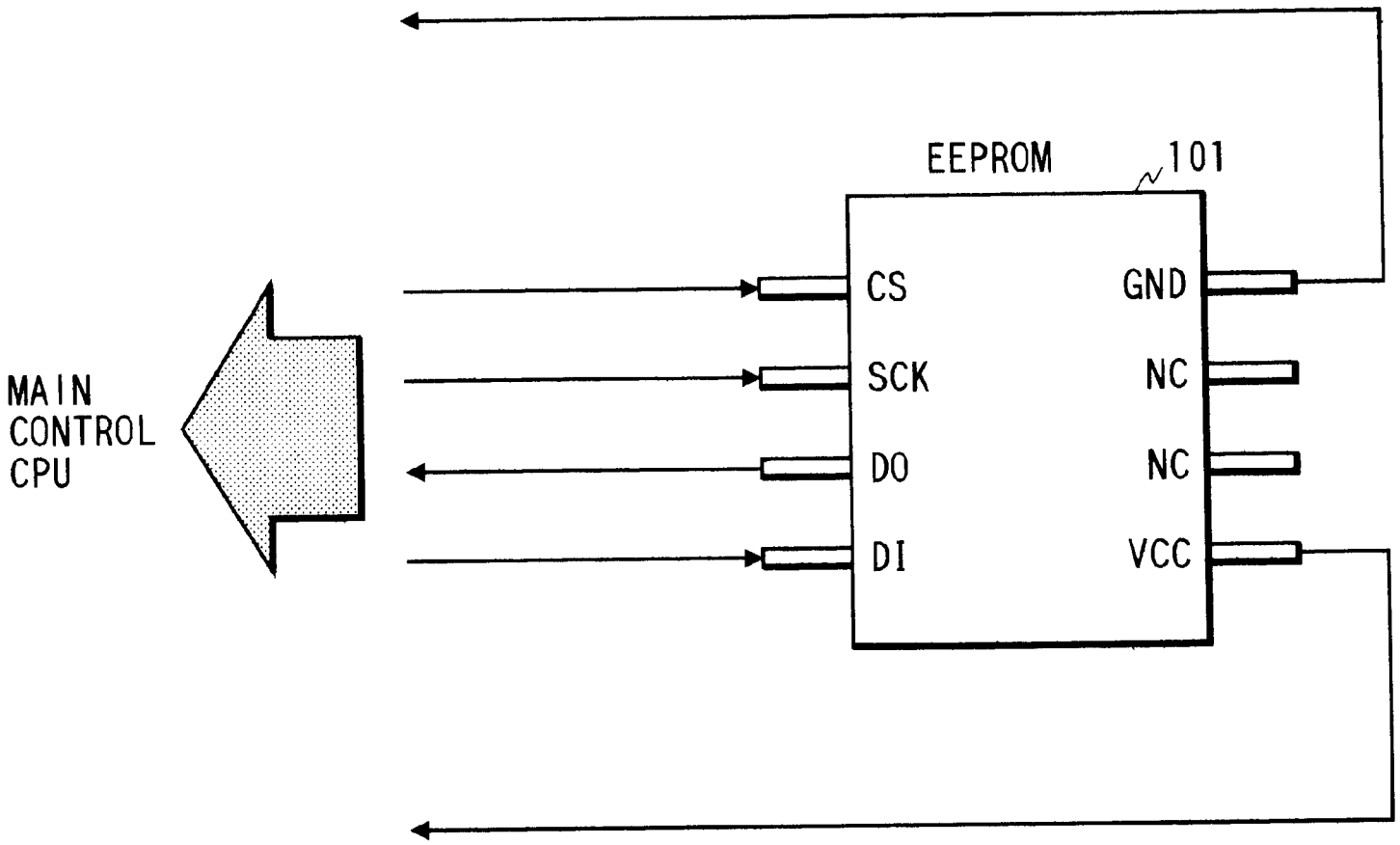
FIG. 5 is a diagram for explaining an EEPROM used in the embodiment 1.

FIG. 5 is a diagram for explaining the EEPROM 101 used in the embodiment. In FIG. 5, CS denotes a chip selection terminal to selectively access the EEPROM 101; SCK a clock input terminal; DO a serial data output terminal; DI a serial data input terminal; VCC and GND power source terminals; and NC non-connection.

Figure 6A:
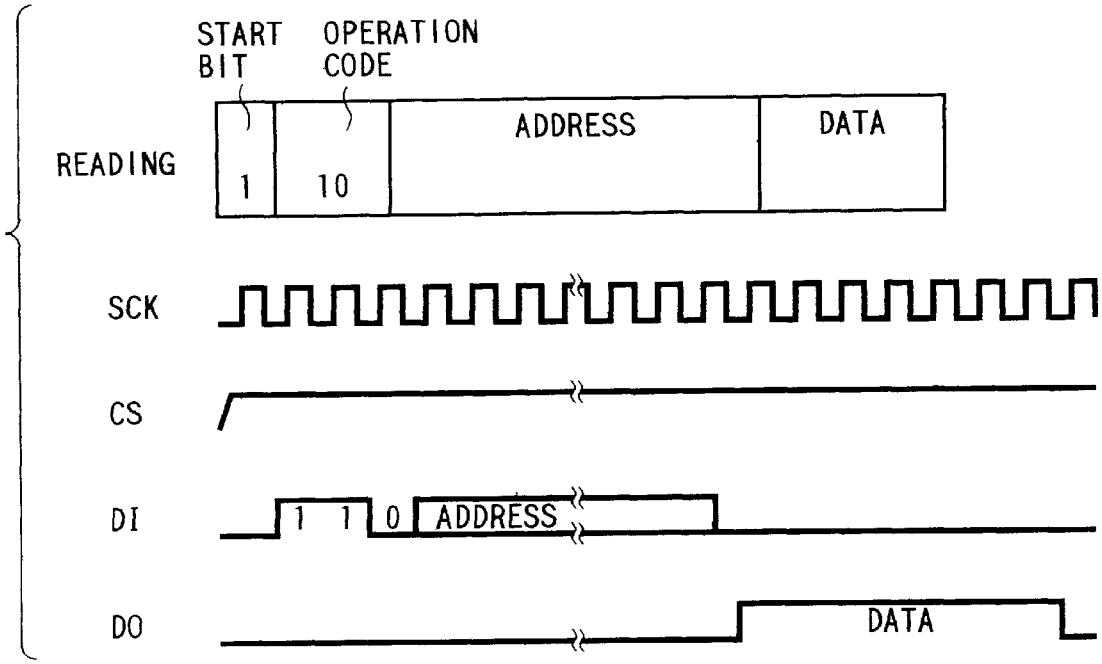
FIG. 6A is a timing chart showing a state upon reading of the EEPROM in FIG. 5.
Figure 6B:
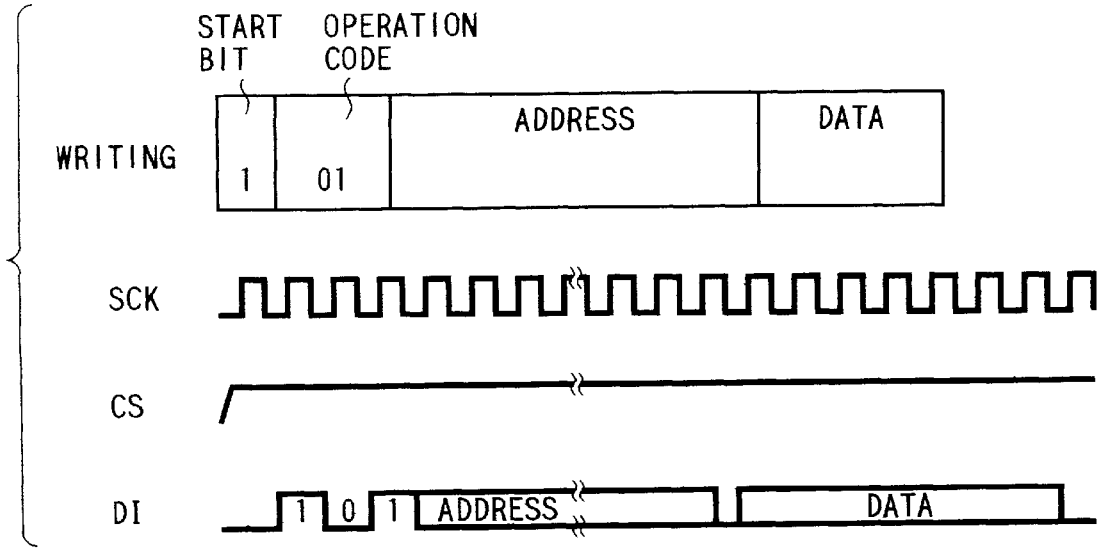
FIG. 6B is a timing chart showing a state upon writing of the EEPROM in FIG. 5.

FIGS. 6A and 6B are diagrams showing timing charts upon reading and writing of the EEPROM 101. The input and output of data to/from the EEPROM 101 are executed by a serial communication. A data structure of the serial communication is constructed by a start "1" bit, an operation code "2" bits indicative of the contents of a command, an address, and data. FIG. 6A shows the timing upon reading. First, when a start signal, an operation code, and an address are transmitted from the main control CPU 401 synchronously with the clock, the data is outputted from the serial data output terminal DO synchronously with the clock. FIG. 6B shows a state upon writing. A start signal, an operation code, an address, and data which are transmitted synchronously with the clock from the main control CPU 401 are written from the serial data input terminal DI.

Figure 7:
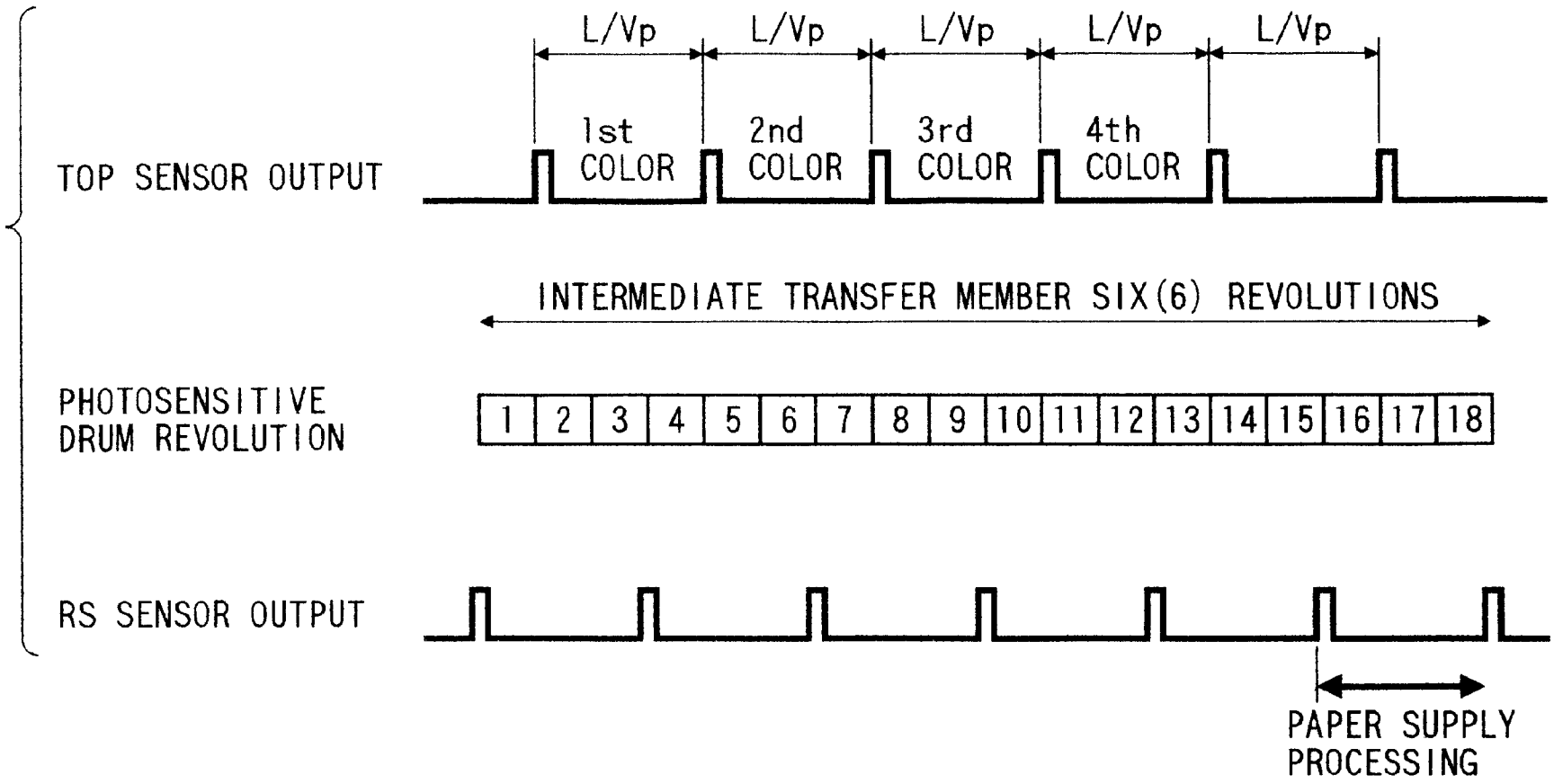
FIG. 7 is a timing chart showing the relations among an output waveform of a TOP sensor, an output waveform of an RS sensor, and a revolution of the photosensitive drum in the embodiment 1.

FIG. 7 is a diagram showing an output waveform of the TOP sensor 9*a* and an output waveform of the RS sensor 9*b* which are generated by the rotation of the intermediate transfer member 9 upon formation of a full color image and a timing of the rotation of the photosensitive drum 15. In FIG. 7, Vp denotes a rotational speed of the intermediate transfer member 9 and L/Vp indicates a time that is required for one revolution of the intermediate transfer member 9. While the intermediate transfer member 9 rotates four times, the toners of four colors are overlapped, thereby forming an image. After the image of the fourth color has been formed, the paper supply processing is executed at the timing of the RS sensor 9*b,* a color visible image is transferred to the transfer member 2, and a series of image forming processings are finished. For such an image forming state, the intermediate transfer member 9 rotates six times. For example, when there is a relation of N=3, the photosensitive drum 15 rotates 18 times. The number of revolutions "6" of the intermediate transfer member 9 is accumulated and written into the EEPROM 101.

Figure 8A:
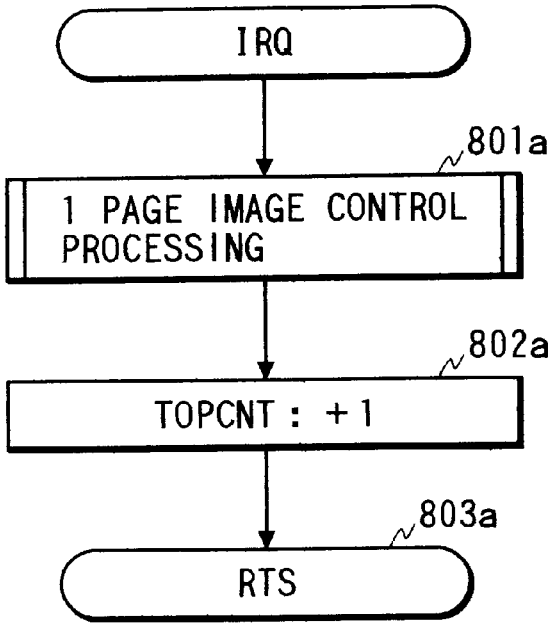
FIGS. 8A, 8B, 8C, and 8D are flowcharts for allowing a main control CPU to execute the control of FIG. 7.
Figure 8C:
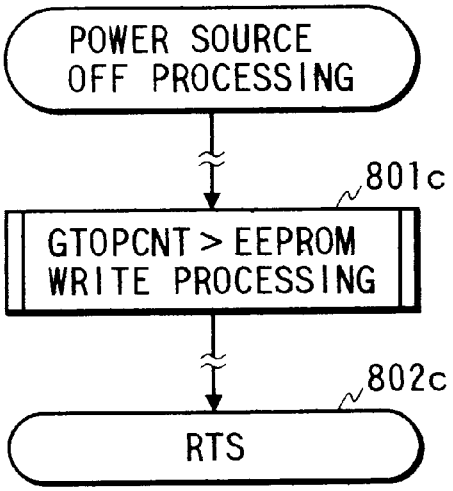
Figure 8D:
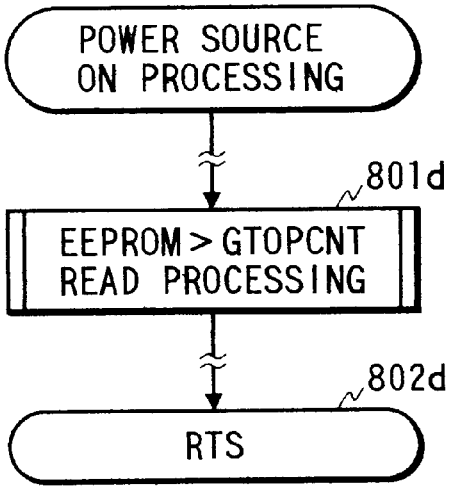
Figure 8B:
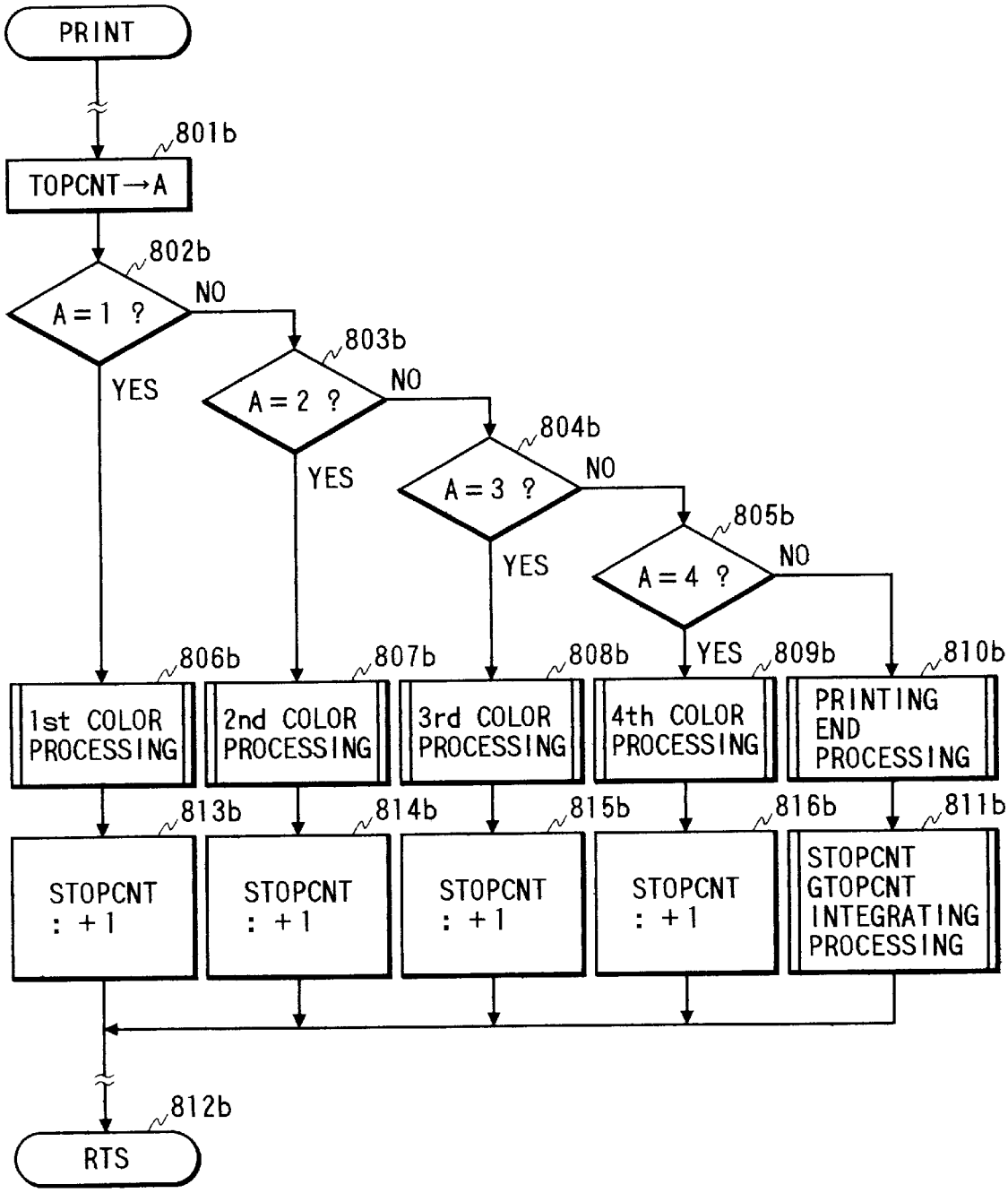

FIGS. 8A to 8D are flowcharts for executing the control shown in FIG. 7 by the main control CPU 401. Fig. 8A shows a schematic processing when the output of the TOP sensor 9*a* is inputted to an interruption terminal IRQ of the main control CPU 401. In step 801*a,* an image control processing such as a setting of image forming conditions of one page or the like is executed. In step 802*a,* a counter TOPCNT is increased in order to measure the number of revolutions of the intermediate transfer member 9. In step 803*a,* an interrupt processing is finished. FIG. 8B shows a schematic processing during the image formation of the main control CPU 401. In step 801*b,* a count value of the counter TOPCNT is transferred to a register A. In steps 802*b* to 805*b,* the intermediate transfer member 9 is at which number of revolutions and at which color are judged. In steps 806*b* to 809*b,* image formation processings such as high voltage control of each color, scanner control by the laser, and the like are executed. In steps 813*b* to 815*b,* a counter STOPCNT is set to an ink back side in order to measure the number of revolutions of the intermediate transfer member 9 during the image formation. In step 810*b,* image forming end processing such as high voltage stop control, scanner stop control, and the like are executed. In step 811*b,* a processing for accumulating a count value of the rotation counter STOPCNT of the intermediate transfer member 9 during the image formation to an integration counter GTOPCNT is executed. In step 812*b,* the schematic processing during the image formation is finished. FIGS. 8C and 8D show processing when the power source of the color image forming apparatus is OFF or ON. In FIG. 8C, in step 801*c,* a processing for writing a count value of the integration counter GTOPCNT into the EEPROM 101 is executed. In step 802*c,* the write processing is finished. In FIG. 8D, in step 801*d,* a processing for reading the value stored in the EEPROM 101 to the integration counter GTOPCNT is executed. In step 802*d,* the read processing is finished.

Figure 9:
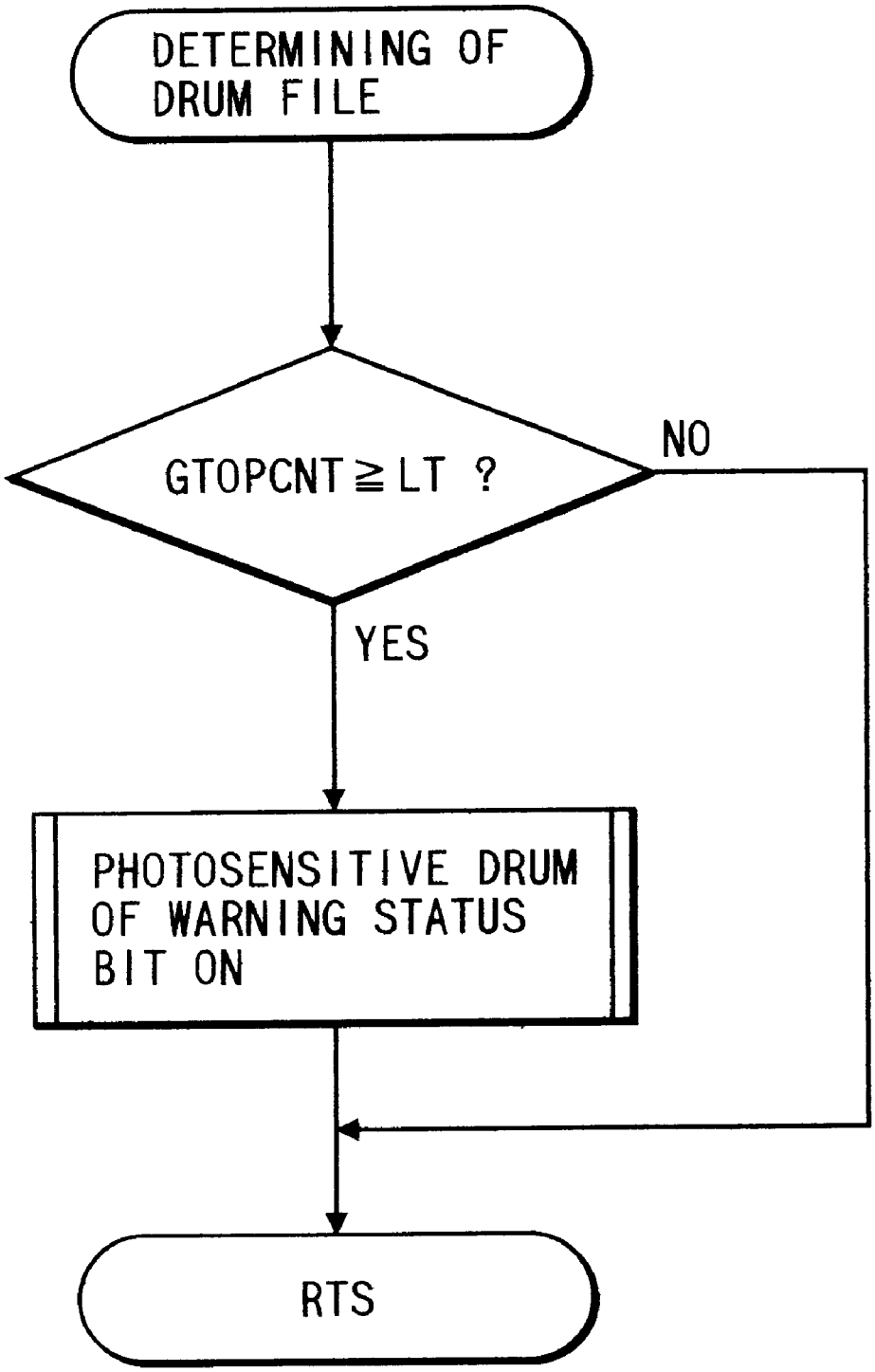
FIG. 9 is a flowchart for judging whether a value of an integrating counter has reached a life LT or not and for controlling a photosensitive drum life bit on a status when it reaches the life LT.

In FIG. 9, the main control CPU 401 also serving as judging means discriminates whether the count value of the integration counter GTOPCNT has reached the life LT or not. If YES, a life bit of the photosensitive drum 15 on a status is turned on and a warning is sent to the external controller (not shown) through the image data I/F 400, thereby promoting the exchange of the photosensitive drum 15.

As mentioned above, by accumulating the number of revolutions of the intermediate transfer member and judging the life of the photosensitive member, the integration number is reduced and a memory capacity can be reduced.

The second embodiment of the invention will now be described.

Figure 10:
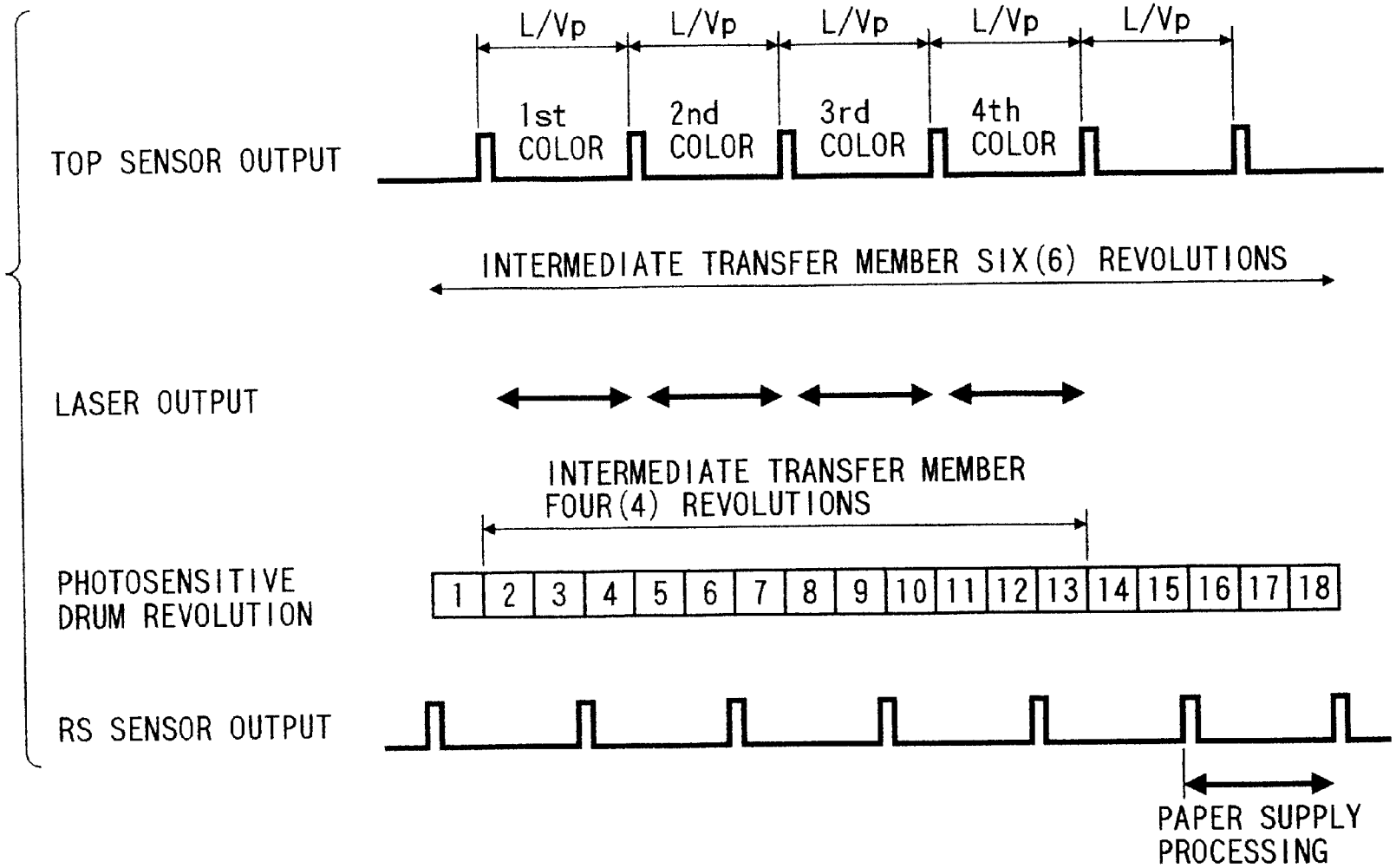
FIG. 10 is a timing chart showing the relations among an output waveform of a TOP sensor, an output waveform of an RS sensor, and a revolution of a photosensitive drum in the embodiment 2.

FIG. 10 is a timing chart showing the relations among an output waveform of a TOP sensor, an output waveform of an RS sensor, and the rotation of a photosensitive drum in the second embodiment.

Since the photosensitive drum 15 is largely abraded by the contact of the cleaner blade 16 during the deposition of the toner, the presence or absence of the toner during the cleaning by the cleaner blade 16 largely influences on the life of the photosensitive drum 15. Therefore, in the example, the main control CPU 401 also serving as judging means discriminates whether the rotation of the intermediate transfer member 9 corresponds to the operation during the deposition of the toner to the photosensitive drum 15 or not. The rotation of the intermediate transfer member 9 in the image forming state during the toner deposition (in FIG. 10, during outputting of the laser by the scanner control, namely, the revolution of the photosensitive drum 15 lies within a range from the second revolution to the thirteenth revolution) is set to, for example, a weight "2" and the revolution of the intermediate transfer member 9 in the other image forming state is set to a weight "1", thereby weighting, and such weight is integrated to the integration counter GTOPCNT. Upon turn-off of the power source, the integration counter value is written into the EEPROM 101 as life information of the photosensitive drum 15.

By adding a weight to the integration value in dependence on the difference of the image forming state, the life of the photosensitive member can be further correctly detected.

The third embodiment of the invention will now be described.

Figure 11:
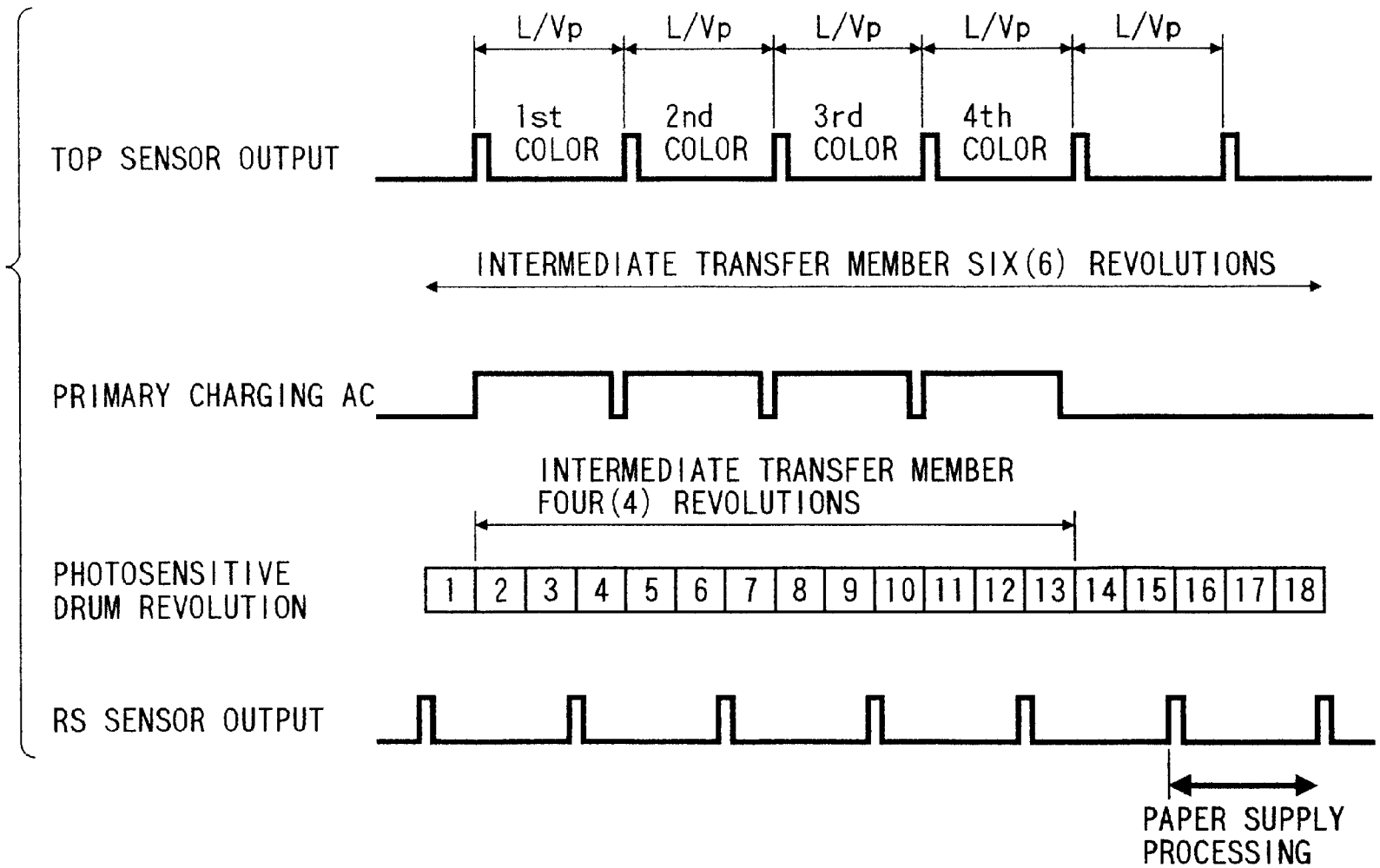
FIG. 11 is a timing chart showing the relations among an output waveform of a TOP sensor, an output waveform of an RS sensor, and a revolution of a photosensitive drum in the embodiment 3.
Figure 12:
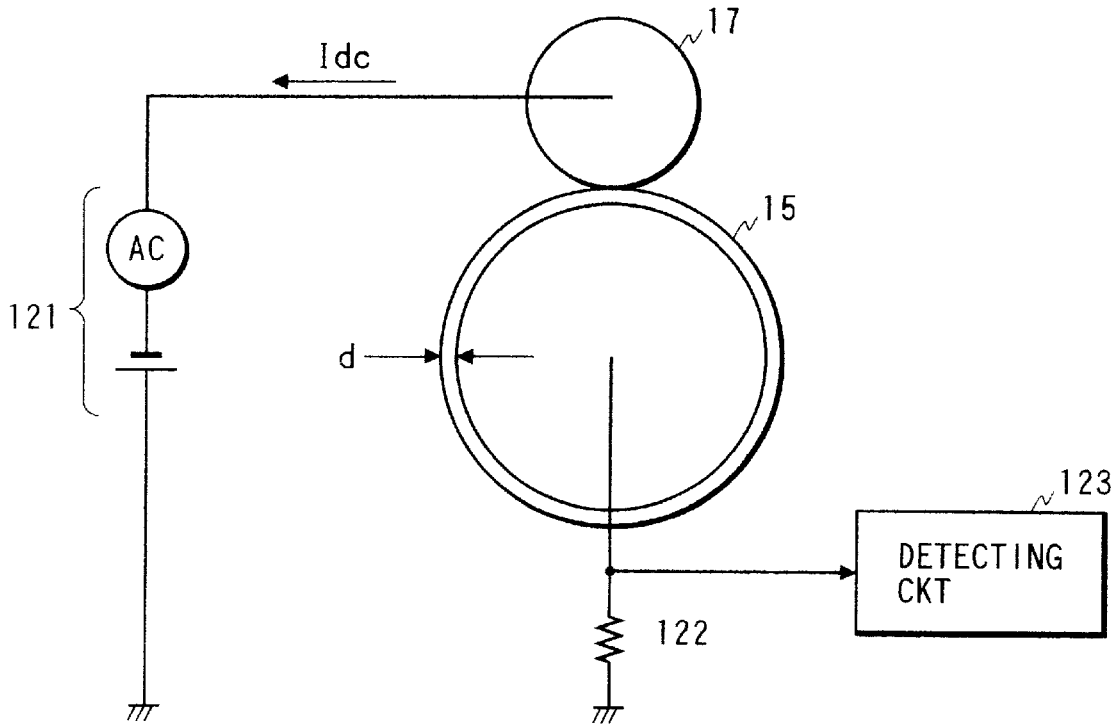
FIG. 12 is a schematic constructional diagram showing a life detecting apparatus of a photosensitive drum for judging a life from a value of a current flowing to the photosensitive drum.

FIG. 11 is a timing chart showing the relations among an output waveform of a TOP sensor, an output waveform of an RS sensor, and the rotation of the photosensitive drum according to the third embodiment.

The operations in which an AC bias voltage is applied to the contact charging roller 17 and the photosensitive drum 15 is primary charged by the contact charging roller 17, exert a large influence on the life of the photosensitive drum 15. In the example, therefore, whether the rotation of the intermediate transfer member 9 is the rotation for a period of time during which a bias voltage to primary charge the photosensitive drum 15 is being supplied or not is judged by judging means. The rotation of the intermediate transfer member 9 in the image forming state during the supply of the AC bias voltage upon primary charging (the revolution of the photosensitive drum 15 in a range from the second revolution to the thirteenth revolution) is set to a weight "2" and the rotation of the intermediate transfer member 9 in the other image forming state is set to a weight "1", thereby weighting. Such weight is integrated to the integration counter GTOPCNT. Upon turn-off of the power source, the integration count value is written into the EEPROM 101 as life information of the photosensitive drum 15.

As mentioned above, when performing the primary charging by the voltage having the AC component, by weighting the integration value in the operating state of the primary charging unit, the life of the photosensitive member can be judged at a high precision.

Although the embodiments of the invention have been described above, the invention is not limited to the foregoing embodiments but many modifications and variations are possible within the spirit and scope of the appended claims of the invention.

What is claimed is:

1. An image forming apparatus comprising:

a photosensitive member unit which is detachably mountable to a main body of said image forming apparatus;

an electrophotographic photosensitive member for bearing an electrostatic image, said electrophotographic photosensitive member being provided in said photosensitive member unit;

developing means for developing the electrostatic image on said electrophotographic photosensitive member with a plurality of color toners;

an intermediate transfer rotary member to which a toner image on said electrophotographic photosensitive member is transferred and which transfers the toner image from said electrophotographic photosensitive member to a recording material;

wherein a circumference of said intermediate transfer rotary member is larger than a circumference of said electrophotographic photosensitive member;

a sensor for detecting a start position for transferring the toner image onto said intermediate transfer rotary member to send a signal;

a controller for controlling image formation processing, said controller integrating information on a number of revolutions of said intermediate transfer rotary member based on the signal from said sensor; and a memory for storing the integrated number of revolutions of said intermediate transfer rotary member, said memory being provided on said photosensitive member unit, wherein said controller judges a life of said electrophotographic photosensitive member by comparing the integrated number of revolutions of said intermediate transfer rotary member with a predetermined value which is obtained based on a relation of the circumferences of said intermediate transfer rotary member and said electrophotographic photosensitive member.

2. An apparatus according to claim 1, wherein the circumference of said intermediate transfer rotary member is substantially integer times as large as the circumference of said electrophotographic photosensitive member.

3. An apparatus according to claim 1, wherein said memory is a nonvolatile memory.

4. An apparatus according to claim 1, wherein the revolution number information is weighted based on a difference of an operating state of a primary charging unit relative to said electrophotographic photosensitive member.

5. An apparatus according to claim 4, wherein said apparatus further includes exposing means for exposing an image of said electrophotographic photosensitive member, and the weighing is executed based on whether said exposing means is exposing or not.

6. An apparatus according to claim 4, wherein said apparatus further includes charging means for uniformly charging said electrophotographic photosensitive member, and the weighing is executed based on a difference of the operating state of said primary charging unit.

7. An apparatus according to claim 1, wherein said developing means has a plurality of developing units each containing a toner of a different color, toner images are sequentially overlapped and transferred onto said intermediate transfer rotary member, thereafter, the laminated toner images are transferred in a lump onto the recording material.

8. An apparatus according to claim 1, wherein said intermediate transfer rotary member rotates in an interlocking relation with said electrophotographic photosensitive member.

* * * * *

UNITED STATES PATENT AND TRADEMARK OFFICE

CERTIFICATE OF CORRECTION

PATENT NO. : 6,112,036

DATED : August 29, 2000

INVENTOR(S): HAYATO SHINOHARA

It is certified that error appears in the above-identified patent and that said Letters Patent is hereby corrected as shown below:

COLUMN 2:
Line 65, "cross sectional" should read --cross-sectional--.

COLUMN 6:
Line 9, "be" should be deleted.

COLUMN 7:
Line 52, "controls;" should read --controls--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*